US009924752B2

(12) United States Patent
Horrey

(10) Patent No.: US 9,924,752 B2
(45) Date of Patent: Mar. 27, 2018

(54) SHIRTTAIL RETENTION SYSTEM

(71) Applicant: Michael M. Horrey, Cherry Hill, NJ (US)

(72) Inventor: Michael M. Horrey, Cherry Hill, NJ (US)

( * ) Notice: Subject to any disclaimer, the term of this patent is extended or adjusted under 35 U.S.C. 154(b) by 51 days.

(21) Appl. No.: 15/156,801

(22) Filed: May 17, 2016

(65) Prior Publication Data

US 2016/0338436 A1 Nov. 24, 2016

Related U.S. Application Data

(60) Provisional application No. 62/163,546, filed on May 19, 2015.

(51) Int. Cl.
*A41F 17/00* (2006.01)
*A41F 17/02* (2006.01)

(52) U.S. Cl.
CPC ..... *A41F 17/00* (2013.01); *A41F 17/02* (2013.01)

(58) Field of Classification Search
CPC ..... A41F 11/16; A41F 17/00; A41F 11/02; A41F 11/14; A41F 15/002; A41F 17/04; A41F 19/00; A41F 3/02; A41F 5/00; A41F 11/18; A41F 9/002; Y10T 24/2708; Y10S 2/92
See application file for complete search history.

(56) References Cited

U.S. PATENT DOCUMENTS 1,374,572 A * 4/1921 Hurd ..... A41F 11/16 2/308
1,404,181 A * 1/1922 Alsop ..... A41F 11/16 2/308
1,404,719 A * 1/1922 Postl ..... A41F 11/02 2/326
1,535,650 A * 4/1925 Burtchby ..... A41F 11/14 450/106
1,638,304 A * 8/1927 Guy ..... A41F 11/02 2/326
1,653,288 A * 12/1927 Johnson ..... A41F 17/00 2/326
1,859,097 A * 5/1932 Kayser ..... A41F 11/02 2/313
2,145,514 A * 1/1939 Kennedy ..... A41F 11/16 2/308
3,501,774 A * 3/1970 Norman ..... A41F 11/16 2/240
4,853,979 A * 8/1989 Ryder ..... A41F 17/00 2/326
7,849,523 B2 * 12/2010 Crittenden ..... A41F 11/14 2/232
8,429,773 B2 * 4/2013 Herman ..... A47C 21/022 24/72.5
9,049,895 B1 * 6/2015 Wesol ..... A41F 5/00
2009/0235432 A1 * 9/2009 Crittenden ..... A41F 17/04 2/232

(Continued)

*Primary Examiner* — Bobby Muromoto, Jr.
(74) *Attorney, Agent, or Firm* — Stuart M. Goldstein

(57) ABSTRACT

A shirttail retention system has two shay retention suspenders, one for each thigh or upper leg of the wearer. Each retention suspenders has a circular, elastic strap which encircles the wearer's thigh, an elastic strip extending from the strap to the shirttail, and fastening clips at the ends of the strip for securing the strip and, thus, the suspenders to the shirttail.

3 Claims, 3 Drawing Sheets

(56) References Cited

U.S. PATENT DOCUMENTS

| | | | | |
|---|---|---|---|---|
| 2010/0235969 | A1* | 9/2010 | Isaacson | A41F 17/00 2/404 |
| 2011/0167540 | A1* | 7/2011 | Little | A41F 9/002 2/312 |
| 2013/0247280 | A1* | 9/2013 | Haggard | A41F 11/14 2/256 |
| 2015/0135395 | A1* | 5/2015 | Galil | A41F 17/00 2/69 |
| 2016/0198784 | A1* | 7/2016 | Gilroy | A41F 3/02 2/326 |

* cited by examiner

SHIRTTAIL RETENTION SYSTEM

RELATED APPLICATION

The herein application claims the benefit of provisional application Ser. No. 62/163,546 filed on May 19, 2015.

FIELD OF THE INVENTION

This invention relates to hold-down devices for retaining the lower portion of a shirt in place, neatly tucked into the wearer's pants.

BACKGROUND OF THE INVENTION

Routine and normal body movements, such as raising one's arms, sitting, bending, walking, or running, will cause a shirt, otherwise neatly tucked into pants, to raise up, causing the shirttails of the shirt to be pulled up and, sometimes, out of the pants. This not only creates a sloppy or unkept appearance, but also requires the wearer to frequently tuck in his or her shirt.

This is especially a problem when the shirt wearer is involved in an activity which requires fast moving or strenuous activity, such as playing a sport or officiating a sporting event. For instance when officiating sports such as basketball or football, the official is constantly running, jumping, and moving. As a result of such activity, the officials shirt becomes loose and, often times, is inadvertently pulled out of place. Since such officials are required to maintain uniform decorum, in order to maintain a level of professionalism and command respect, their Shirts must be neatly tucked in to their pants, whether they be long or short, at all times.

There are numerous other individuals who are required to maintain a neat and "tucked in" appearance, such as military personnel, athletes, police, and even actors who engage in activities which result in shirts being pulled from pants.

Current shirt retention devices are bulky, uncomfortable and they are usually designed to be worn only with long pants. Many such devices also easily detach, especially if the wearer is involved in physical activity, due to awkward body movements and constant activity.

SUMMARY OF THE INVENTION

It is thus the object of the present invention to overcome the limitations and disadvantages of existing shirt and shirttail retention systems.

It is the object of the present invention to provide a shirttail retention system which effectively and comfortably retains the shirttail of the wearer's shirt neatly tucked in pants, both long and short.

It is another object of the present invention to provide a shirttail retention system which effectively and comfortably retains the shirttail of a sporting official's shirt during constant and strenuous activity.

It is a further object of the present invention to provide a shirttail retention system which effectively and comfortably retains the shirttail of any shirt wearer who requires that his or her shirt is, at all times, tucked into pants in order to present a neat and tidy appearance, including, but not limited to military personnel, police, athletes, and actors.

These and other objectives are accomplished by the present invention, a shirttail retention system comprising two shirttail retention suspenders, one for each thigh or upper leg of the wearer. Each retention suspenders has a circular, elastic strap which encircles the wearer's thigh, an elastic strip extending from the strap to the shirttail, and fastening clips at the ends of the strip for securing the strip and, thus, the suspenders to the shirttail.

The novel features Which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

The shirttail retention system of the present invention comprises first shirttail retention suspenders 2 configured to be used on the left upper leg or thigh area L of shirt wearer W and second identical shirttail suspenders 4 configured to he used on the right upper leg or thigh area R of the wearer.

Figure 1:
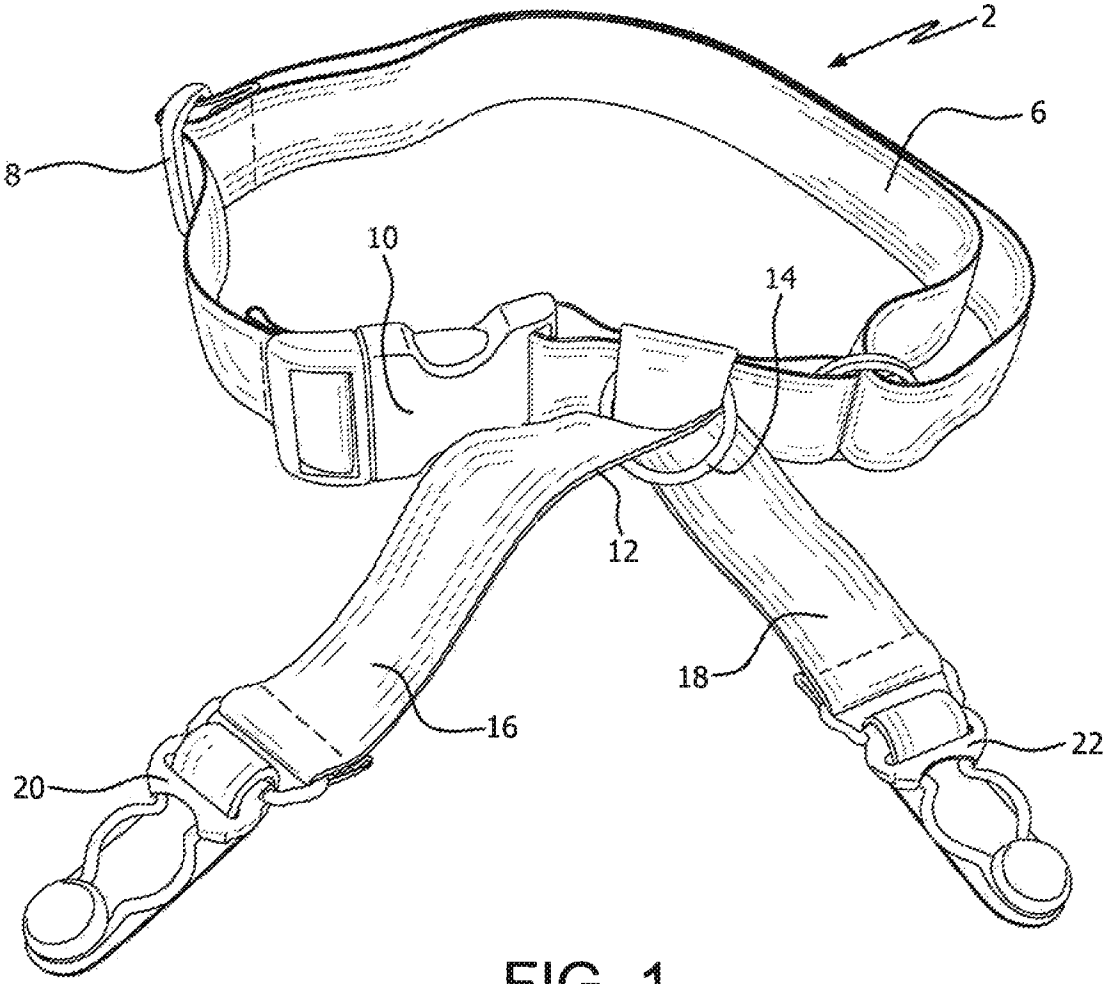
FIG. 1 is a perspective view of one of the shirttail retention suspenders of the shirttail retention system of the present invention.

With particular reference to FIG. 1, shirttail retention suspenders 2 comprises circular strap 6, configured to encircle thigh L of wearer W. Strap 6 is made of elastic material. The elasticity of strap 6 in combination with adjustment means in the form of strap slider 8 allows the wearer to vary the length of strap 6, according to the size of the wearer's thigh. Connector means in the form of buckle 10 or equivalent connector secures and maintains strap 6 around thigh L of wearer W and allows ready removal of shirttail retention suspenders 2 from the wearer.

Elastic strip 12, also made of elastic material, is retained on strap 6 by means of loop member 14, which is connected to the strap. Strip 12 extends through loop member 14 forming leg sections 16 and 18, each leg section configured to extend from strap 6 to shirttail ST of shirt S worn by wearer W. Fastening means in the form of garter type snap clips 20 and 22 are located at the ends of leg sections 16 and 18. Clips 20 and 22 attach leg sections 16 and 18 to shirttail ST.

As previously stated, shirttail retention suspenders 4 is identical to shirttail retention suspenders 2 as described, shirttail retention suspenders 4 also having circular strap 5, strap slider 7, buckle 9, strip 11, loop member 13, leg sections 15 and 17, and snap clips 19 and 21.

Figure 3:
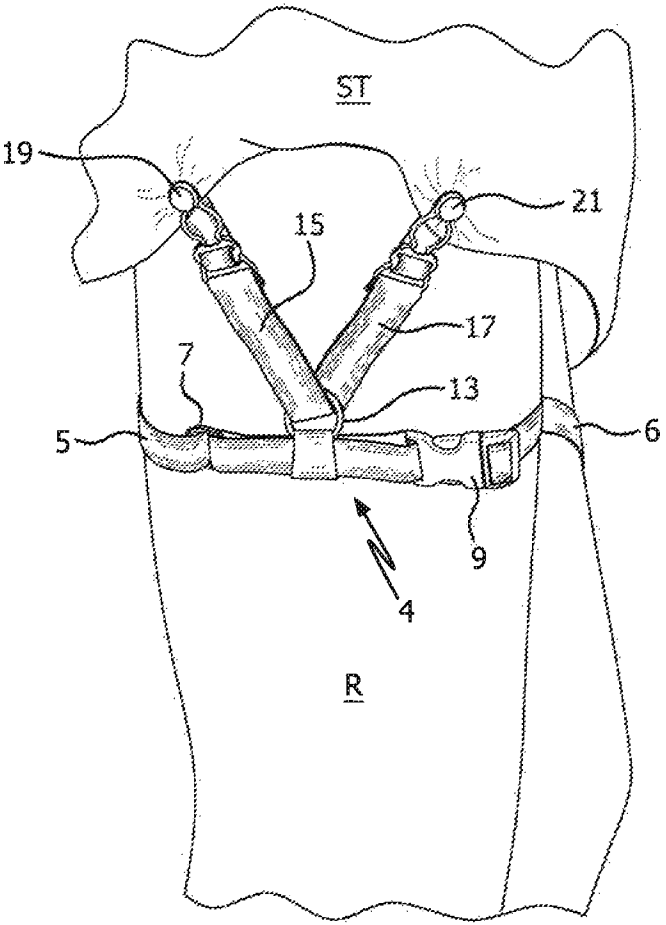
FIG. 3 is a view of the shirttail retention suspenders in place around the right upper leg or thigh of a wearer.
Figure 2:
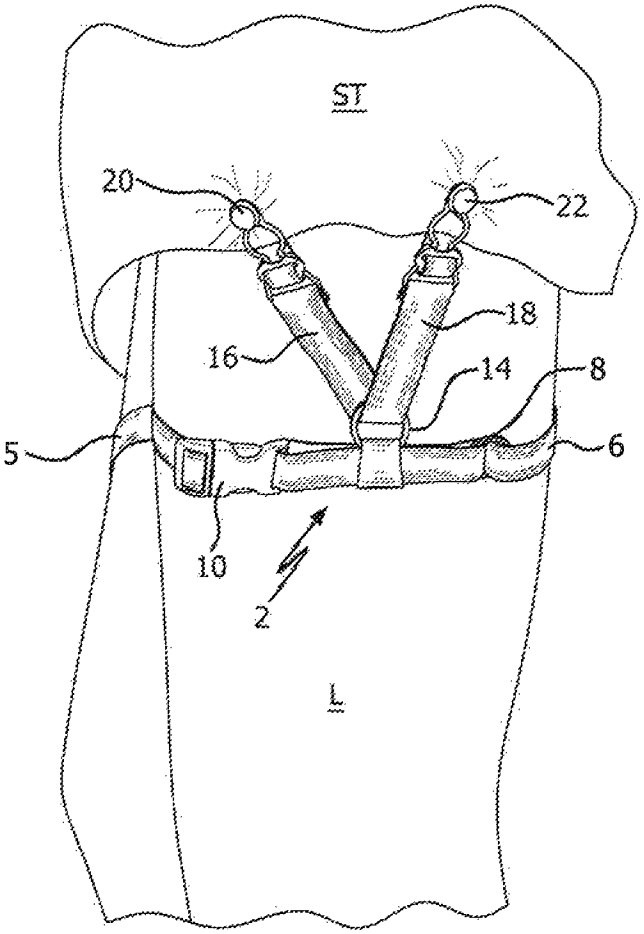
FIG. 2 is a view of the shirttail retention suspenders in place around the left upper leg or thigh of a wearer.

In operation, and as best seen in FIGS. 2 and 3, strip 6 of shirttail retention suspenders 2 is positioned around thigh L of wearer W, and its length adjusted by means of strap slider 8 to fit snugly around the thigh. Buckle 10 is secured to hold strap 6 in position around thigh L. Leg sections 16 and 18 are extended from strap 6 to shirttail ST and fastened to the shirttail by means of clips 20 and 22 in order to secure strap 6 to the shirttail The identical operation is conducted with shirttail retention suspenders 4 on thigh R of wearer W. That is, strip 5 of shirttail retention suspenders 4 is positioned around thigh R, and its length adjusted by means of slider 7 to fit snugly around the thigh. Buckle 9 is secured to hold strap 5 in position around thigh L. Leg sections 15 and 17 are extended from strap 5 to shirttail ST and fastened to the shirttail by means of clips 19 and 21 in order to secure strap 5 to the shirttail.

Figure 4:
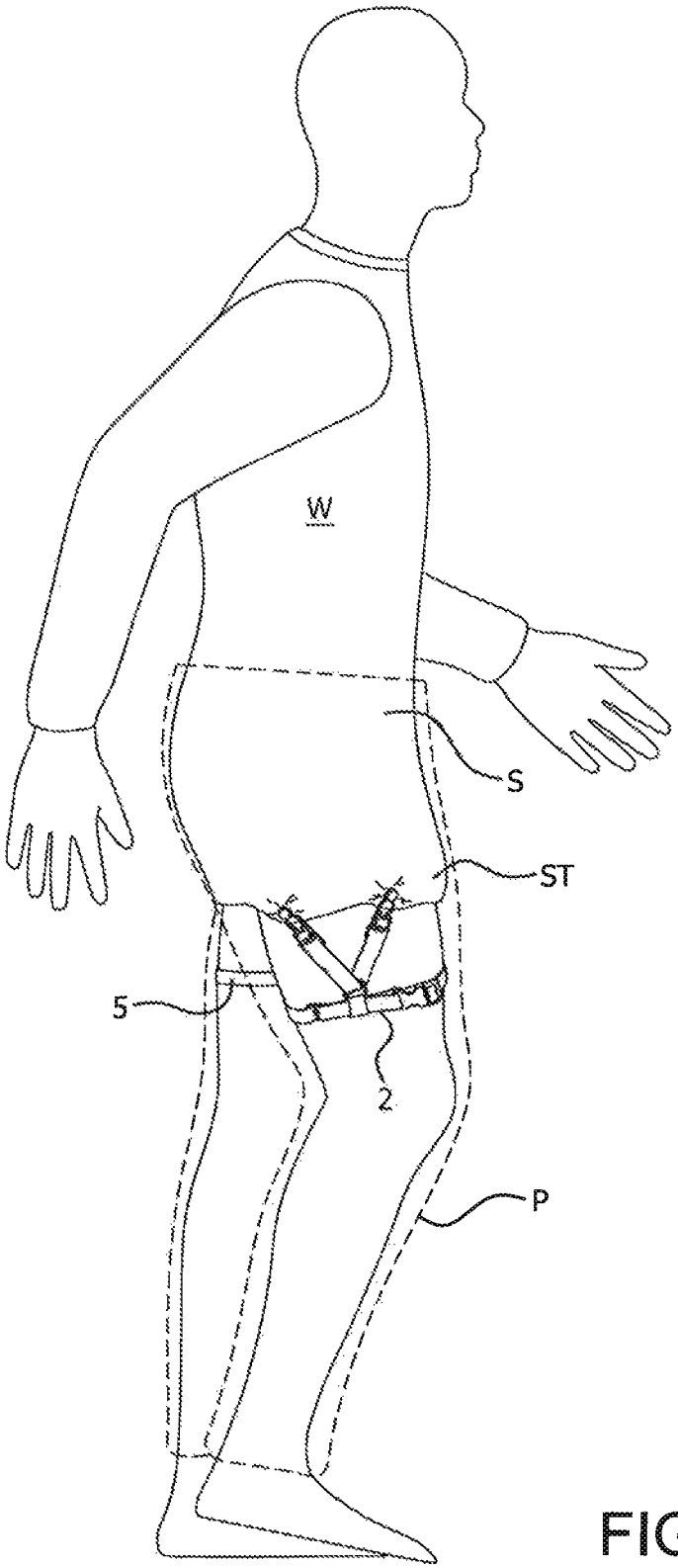
FIG. 4 is a view of the shirttail retention system of the present invention, illustrating the system in position, retaining a wearer's shirt.

Once both shirttail retention suspenders 2 and 4 are in place around thighs L and R of wearer W and their respective strips are fastened to shirttail ST, the shirttails will be retained and remain comfortably tucked into the pants P of the wearer, regardless of the wearer's movements and activity. See FIG. 4.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A shirttail retention system for retaining the position of the shirttail of a shirt on a wearer, the system comprising:

first shirttail retention suspenders comprising first elastic strap means for encircling one thigh of the wearer, a first ring member connected to the strap means, and a first elastic strip passing through the ring member to form two leg sections which extend directly from the first ring member to the shirttails;

second shirttail retention suspenders comprising second elastic strap means for encircling the other thigh of the shirt wearer, a second ring member connected to the second strap means, and a second elastic strip passing through the second ring member to form two leg sections which extend directly from the second ring member to the shirttails, whereby the shirttail is retained in position solely by the two leg sections extending from the first ring member and the two leg sections extending from the second ring member;

fastening means on the first and second elastic strips for securing the strips to the shirttails; and a first buckle connector means for maintaining the first strap means around the one thigh of the shirt wearer and for allowing removal of the first shirttail retention suspenders and second buckle connector means for maintaining the second strap means around the other thigh of the shirt wearer and for allowing removal of the second shirttail retention suspenders.

2. The shirttail retention system as in claim 1 further comprising first adjustment means for varying the length of the first strap means and second adjustment means for varying the length of the second strap means.

3. The shirttail retention system as in claim 1 wherein the fastening means comprises a clip on the ends of each of the leg sections.

* * * * *